United States Patent [19]

Swisher, Jr. et al.

[11] Patent Number: 4,900,186

[45] Date of Patent: Feb. 13, 1990

[54] THREE-TRACK ZERO CLEARANCE PAVER

[76] Inventors: George W. Swisher, Jr., 1500 Dorchester Dr., Oklahoma City, Okla. 73120; Craig R. Gustin, 6208 Ridgecrest Dr., Edmond, Okla. 73034; Stuart W. Murray, 201 Darwin, Edmond, Okla. 73034

[21] Appl. No.: 265,419

[22] Filed: Oct. 31, 1988

[51] Int. Cl.[4] ..... E01C 19/12

[52] U.S. Cl. ..... 404/105; 404/104

[58] Field of Search ..... 404/104, 105, 110, 75, 404/108, 106

[56] References Cited

U.S. PATENT DOCUMENTS

| | | | |
|---|---|---|---|
| 1,662,257 | 3/1928 | Valerio . | |
| 2,116,503 | 5/1938 | Arndt | 94/44 |
| 2,660,937 | 12/1953 | Breeden | 94/46 |
| 2,953,977 | 9/1960 | Warren | 94/44 |
| 3,031,938 | 5/1962 | Bero | 94/46 |
| 3,223,006 | 12/1965 | Jones et al. | 94/45 |
| 3,540,359 | 11/1970 | Swisher, Jr. et al. | 404/110 |
| 3,636,833 | 1/1972 | Lowen et al. | 94/46 |
| 3,844,670 | 10/1974 | Perkins | 404/104 |
| 3,907,451 | 9/1975 | Fisher et al. | 404/101 |
| 3,936,211 | 2/1976 | Miller et al. | 404/104 |
| 3,970,405 | 7/1976 | Swisher, Jr. et al. | 404/105 |
| 4,068,969 | 1/1978 | Beach et al. | 404/98 |
| 4,076,474 | 2/1978 | Catenacci | 425/64 |
| 4,101,237 | 7/1978 | Catenacci | 404/98 |
| 4,272,213 | 6/1981 | McGovarin | 404/118 |
| 4,319,859 | 3/1982 | Wise | 405/268 |
| 4,678,364 | 7/1987 | Charonnat et al. | 404/105 |
| 4,678,365 | 7/1987 | Ban et al. | 404/118 |
| 4,789,266 | 12/1988 | Clarke, Jr. et al. | 404/104 |
| 4,808,026 | 2/1989 | Clarke, Jr. et al. | 404/104 |

*Primary Examiner*—Stephen J. Novosad
*Assistant Examiner*—Gay Spahn
*Attorney, Agent, or Firm*—Dunlap, Codding, Peterson & Lee

[57] ABSTRACT

A method is provided for converting a four-track slip form paver into an improved three-track slip form paver for applying a continuous slab of concrete onto a road surface and against a vertical abutment adjacent the road surface.

12 Claims, 3 Drawing Sheets

THREE-TRACK ZERO CLEARANCE PAVER

BRIEF SUMMARY OF THE INVENTION

1. Field of Invention

The present invention relates to concrete paving apparatus and methods for modifying concrete paving apparatus.

2. Background of the Invention

Generally, when applying a concrete slab to a road surface using an outboard tracked slip form paver, the road surface must be of sufficient width to accommodate the slab and a track path on each side of the slab for track travel. The width of a particular track path generally is equal to that portion of the outboard track extending the greatest distance beyond the respective slip form. Thus, the dimension between the outer edge of the track path and the respective outer edge of the concrete slab applied by the paver is the offset or clearance requirement of the paver.

In some instances, a vertical abutment may border the road surface to be paved such that the outboard tracks can not travel upon or straddle the raised structure. In these instances, any of various complicated procedures must be followed to complete the paving operation.

The method and apparatus of the present invention provide an improved paving apparatus capable of simultaneously applying a concrete slab of substantial width over the surface to be paved and directly against a vertical abutment.

The apparatus of this invention includes a three-track slip form paver having a paving assembly secured to a rigid frame. The paving assembly comprises an open side, devoid of a slip form, extending outwardly from the single track side of the frame and beyond the single track. The paving assembly further includes a single slip form secured to the two track side of the frame.

In operation, the open side of the paving assembly is positioned adjacent the abutment such that concrete material conveyed along the open side is deposited directly against the abutment. As the present invention eliminates the clearance requirement inherent in most outboard track pavers, the apparatus of this invention may be referred to as a zero clearance paver.

BRIEF DESCRIPTION OF THE DRAWINGS

FIG. 6 is a schematic top plan view of the paving apparatus shown in FIG. 4.

DETAILED DESCRIPTION OF THE DRAWINGS

Figure 2:
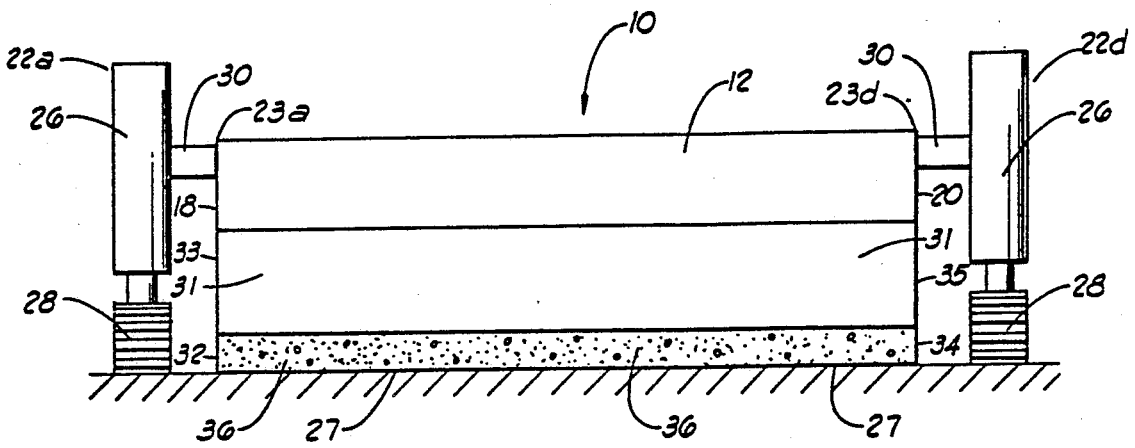
FIG. 2 PRIOR ART
FIG. 2 is a schematic end elevational view of the prior art paving apparatus shown in FIG. 1 applying concrete to a prepared road surface.
Figure 1:
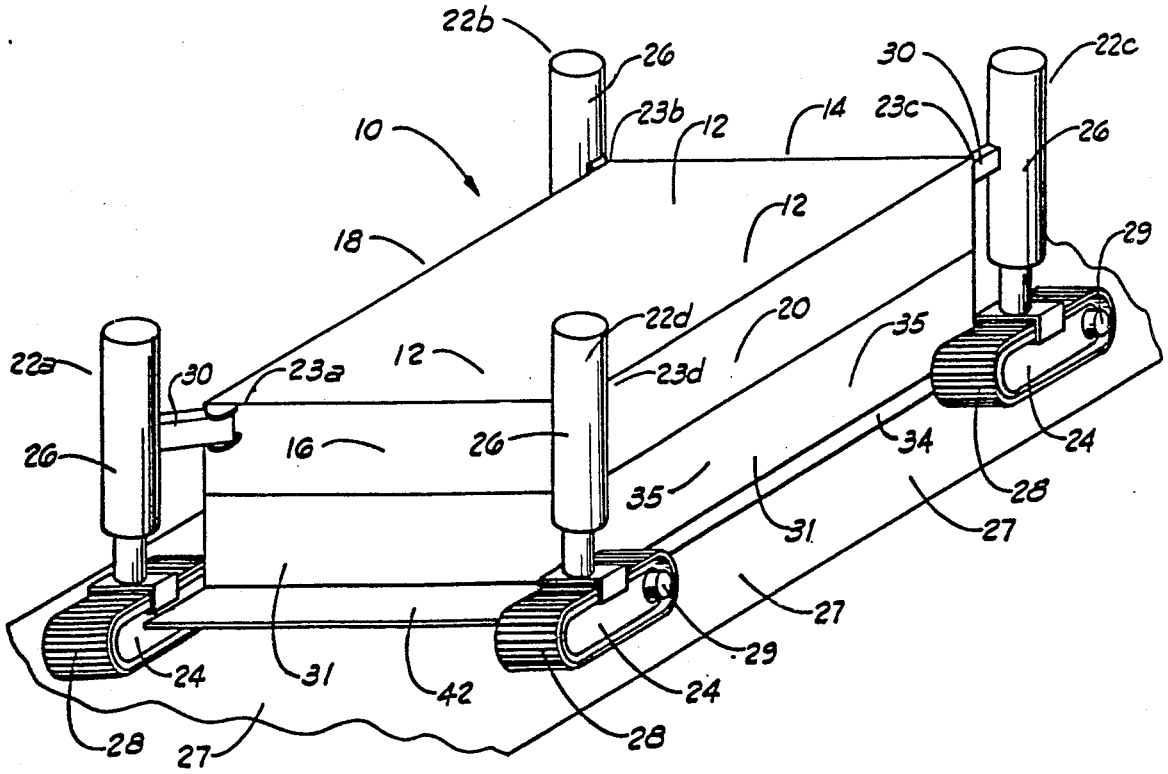
FIG. 1 PRIOR ART
FIG. 1 is a schematic perspective view of a prior art four-track slip form paver.
Figure 2:
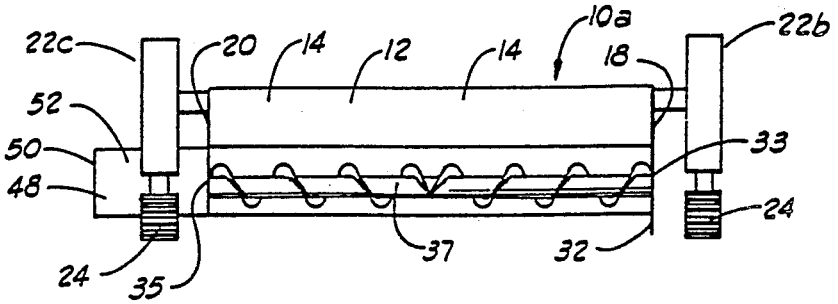
Figure 4:
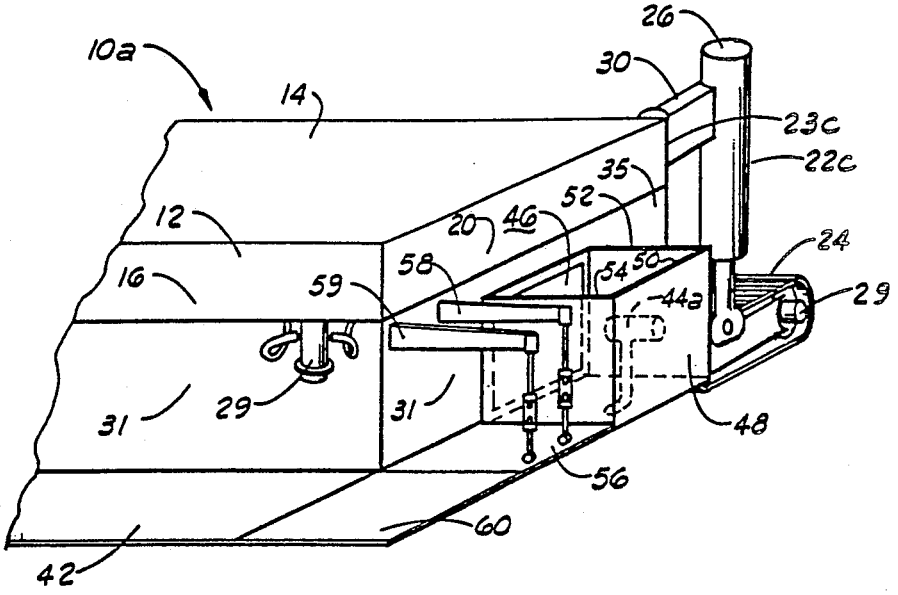
FIG. 4 is an enlarged schematic fragmented perspective view of a side of a three-track slip form paver constructed in accordance with the invention.

Referring to FIGS. 1 and 2, there is illustrated a four-track slip form paver 10 comprising a rigid, rectangular frame 12 having a front end 14, a rear end 16, a first side 18, and a second side 20. The four-track slip form paver 10 further comprises four track assemblies 22*a*, 22*b*, 22*c* and 22*d*. The track assembly 22*a* is secured to a corner 23*a* of the frame 12 formed by the intersection of the rear end 16 with the first side 18. The track assembly 22*b* is secured to a corner 23*b* of the frame 12 formed by the intersection of the front end 14 with the first side 18. The track assembly 22*c* is secured to a corner 23*c* of the frame 12 formed by the intersection of the front end 14 with the second side 20. The track assembly 22*d* is secured to a corner 23*d* of the frame 12 formed by the intersection of the rear end 16 with the second side 20.

Each track assembly comprises a mobile ground support structure 24 and a telescoping leg 26 secured to the mobile ground support structure 24 for adjusting the height of the four-track slip form paver 10 above the prepared road surface 27. Each mobile ground support structure 24 comprises an endless track 28 powered by a hydraulic motor 29 for propelling the four-track slip form paver 10 in a desired direction along the prepared road surface 27. Each track assembly further comprises a support arm 30 for securing the respective telescoping leg 26 to the frame.

The four-track slip form paver 10 further includes a paving assembly 31 secured to the frame and extending from the first side 18 of the frame 12 to the second side 20 of the frame 12. The paving assembly 31 includes a first slip form 32 (FIG. 2) secured to a first paving assembly side 33 of the paving assembly 31 at the first side 18 of the frame 12, and a second slip form 34 secured to a second paving assembly side 35 of the paving assembly 31 at the second side 20 of the frame 12. In operation, as shown in FIG. 2, a concrete slab 36 is generally applied to the prepared road surface 27 between the first slip form 32 and the second slip form 34 of the four-track slip form paver 10.

Figure 3:
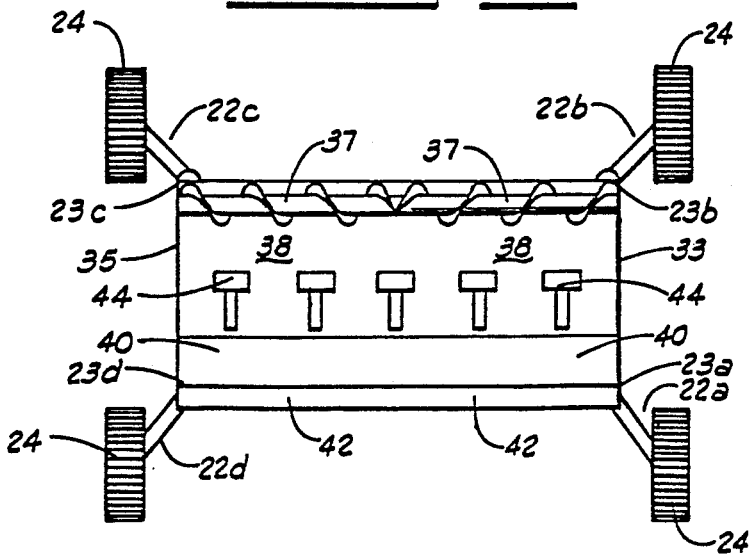
FIG. 3 PRIOR ART
FIG. 3 is a schematic bottom plan view of the prior art paving apparatus shown in FIG. 1.
Figure 5:
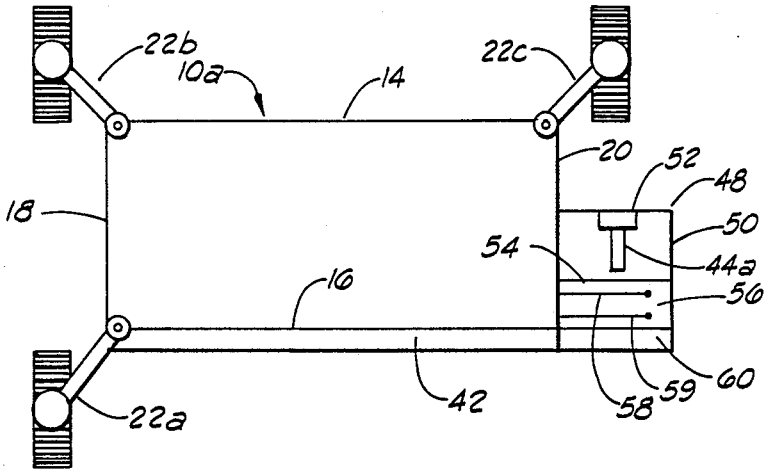
FIG. 5 is a schematic front elevational view of the paving apparatus shown in FIG. 4.
Figure 7:
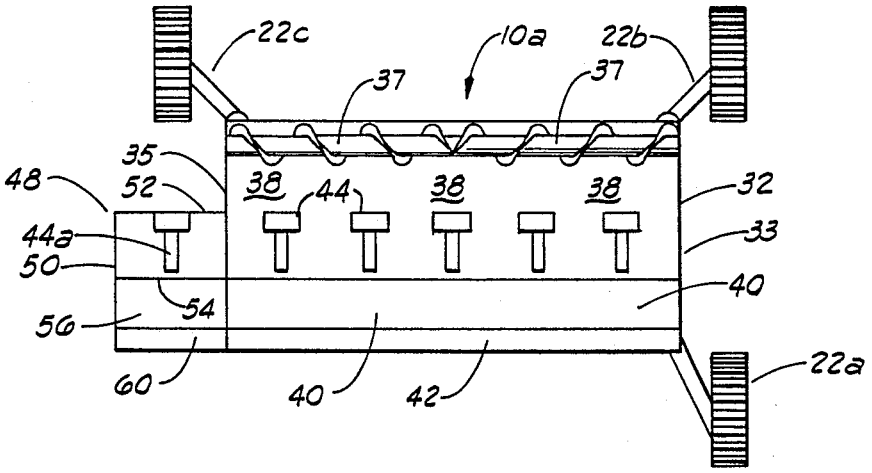
FIG. 7 is a schematic bottom plan view of the paving apparatus shown in FIG. 4.

Referring now to FIG. 3, the paving assembly 31 further includes an auger 37, mounted between the first paving assembly side 33 and the second paving assembly side 35 for spreading concrete to be laid across the paver 10. Additionally, the paving assembly 31 has a hopper 38 containing the auger 37 and extending across the paving assembly 31 between the first paving assembly side 33 and the second paving assembly side 35; a profile pan 40 disposed behind and extending the length of the hopper 38; a float pan 42 disposed behind and extending the length of the profile pan 40, and a plurality of vibrators 44 disposed between the auger 37 and the profile pan 40.

Referring now to FIGS. 1 and 4 through 7, and in accordance with the present invention, the four-track slip form paver 10 is converted to a three-track slip form paver 10*a* by removing the track assembly 22*d* secured to the corner 23*d* of the four-track slip form paver 10. The hydraulic motor 29 (see FIG. 4) previously associated with the removed track assembly 22*d* is left in the hydraulic circuit containing all of the track motors, but is supported on the three-track slip form paver 10*a* such that hydraulic fluid may be circulated therethrough when the three-track slip form paver 10*a* is operated.

An extrusion aperture 46 is provided in a portion of the hopper 38 at the second paving assembly side 35 for conveying concrete material from the hopper 38 outwardly of the second paving assembly side 35 rearward of the mobile ground support structure 24 associated with the track assembly 22*c*.

The second slip form 34 is removed from the second paving assembly side 35. Thus, the second paving assembly side 35 may be referred to as the open side of the paving assembly 31 and the first paving assembly side 33 having the first slip form 32 secured thereto may be referred to as the closed side of the paving assembly 31.

A hopper extension 48 is secured to and extends outwardly from the second paving assembly side 35 such that the hopper extension is rearward of the mobile ground support structure 24 associated with the track assembly 22*c* and in alignment with the extrusion aperture 46 for receiving concrete material dispensed outwardly therefrom. The hopper extension 48 comprises a side plate 50 having a pair of oppositely facing depending front and rear plates 52 and 54 respectively. The front plate 52 and the rear plate 54 are of sufficient dimension such that the side plate 50 extends beyond the mobile ground support structure 24 associated with the track assembly 22*c*. The hopper extension 48 has a vibrator 44*a* disposed therein and secured to an inner surface of the front plate 52.

A profile pan extension 56, extending the width of the hopper extension 48, is secured to the frame 12 in transverse alignment with the profile pan 40. Support assemblies 58 and 59, secured to the second paving assembly side 35, are attached to the profile pan extension 56 and provide additional support for the profile pan extension 56.

A float pan extension 60, extending the width of the profile pan extension 56, is secured to an end of the float pan 42 adjacent the second paving assembly side 35 such that the float pan extension 60 is in transverse alignment with the float pan 42.

Figure 8:
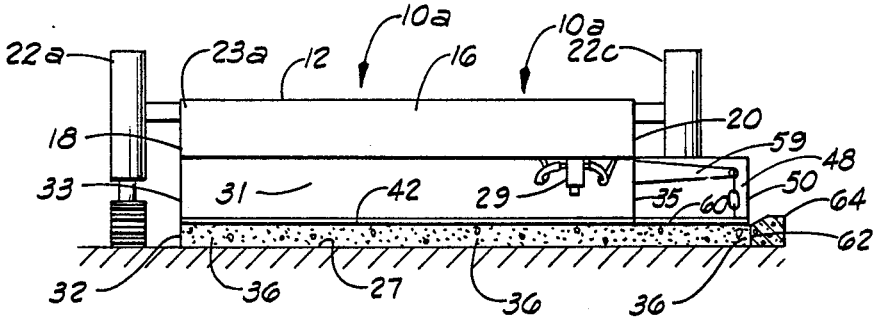
FIG. 8 is a schematic rear elevational view of the paving apparatus shown in FIG. 4 applying concrete onto a prepared road surface and against a vertical surface.

In operation, (see FIG. 8) the three-track paver 10*a* is positioned such that the side plate 50 of the hopper extension 48 is adjacent a vertical surface 62, such as the side of an abutment 64. Upon movement of the three-track slip form paver 10*a* on the track assemblies 22*a*, 22*b*, and 22*c*, the hydraulic motor 29 previously associated with the removed track assembly 22*d* idles. As the three-track slip form paver 10*a* moves forward, concrete material deposited ahead of the three-track slip form paver 10*a* contacts the auger 37. The auger 37 moves the concrete material into the hopper 38 such that a portion of the concrete material is urged through the extrusion aperture 46 and into the hopper extension 48. The vibrators 44 and 44*a* evenly spread the concrete material under the profile pan 40 and the profile pan extension 56 between the first slip form 32 and the vertical surface 62. In this way, the concrete slab 36 is applied over the prepared road surface 27 between the first slip form 32 and against the vertical surface 62 of the abutment 64.

Once the concrete slab 36 is applied as described above, the three-track slip form paver 10*a* may be converted back to the four-track slip form paver 10 by removing the float pan extension 60, the profile pan extension 56, the vibrator 44*a*, and the hopper extension 48. The second slip form 34 is reattached to the second paving assembly side 35 and a plate (not shown), sized for overlying the extrusion aperture 46, is secured to the second paving assembly side 35 covering the extrusion aperture 46. The track assembly 22*d* is reattached to the corner 23*d* of the frame 12 and the hydraulic motor 29 previously supported on the three-track slip form paver 10*a* is reattached to the track assembly 22*d*.

Changes may be made in the construction, operation, and arrangement of the various parts, elements, steps, and procedures described herein without departing from the spirit and scope of the invention as defined in the following claims.

What is claimed is:

1. A slip form paving apparatus for applying a concrete slab onto a substantially horizontal surface and against a substantially vertical surface at one side of the horizontal surface, comprising:

a rigid, rectangular frame having a front end, rear end and first and second sides;

paving means secured to the frame extending from the first side of the frame to a point outwardly of the second side of the frame, the side of the paving means extending beyond the second side of the frame being open;

a slip form on the side of the paving means at said first side of the frame;

first mobile ground support means secured to and supporting the frame at said first side; and second mobile ground support means secured to and supporting the second side of the frame, said second mobile ground support means disposed ahead of the paving means;

said ground support means operable for moving the open end of the second side of the paving means alongside the vertical surface, whereby the concrete laid by the apparatus will abut the vertical surface.

2. A slip form paving apparatus as defined in claim 1 characterized further to include:

a hopper carried by the frame positioned between the paving means and the front of the frame extending from the first side of the frame to a point outwardly of the second side of the frame substantially even with the open side of the paving means; and means in the hopper for spreading concrete along the length of the paving means.

3. The slip form paving apparatus as defined in claim 1 wherein the paving means comprises a profile pan.

4. The slip form paving apparatus of claim 2 wherein the means for spreading the concrete along the length of the paving means comprises:

an auger extending from the first side of the frame to the second side of the frame; and a plurality of vibrators distributed throughout the length of the hopper.

5. The slip form paving apparatus as defined in claim 1 wherein the second mobile ground support means includes:

at least one mobile ground support structure disposed ahead of the paving means.

6. The slip form paving apparatus as defined in claim 5 wherein the mobile ground support structure comprises:

an endless track; and a hydraulic motor for powering the endless track.

7. The slip form paving apparatus as defined in claim 1 wherein the first mobile ground support means includes:

at least one mobile ground support structure.

8. The apparatus of claim 7 wherein the first mobile ground support means comprises:

a first mobile ground support structure; and a second mobile ground support structure, wherein the first mobile ground support structure is secured adjacent to a corner of the frame formed by the intersection of the front end of the frame with the first side of the frame, and wherein the second mobile ground support structure is secured adjacent to a corner of the frame formed by the intersection of the rear end of the frame with the first side of the frame.

9. The apparatus of claim 8 wherein the first mobile ground support structure and the second mobile ground support structure each comprise:

an endless track; and a hydraulic motor for powering the endless track.

10. A method of converting a four-track slip form paver to a three-track slip form paver capable of paving against a vertical surface at one side of the path of travel of the paver, the four track paver having a rectangular frame with a front end a rear end and two sides and a mobile ground support structure at each corner, a hopper extending across the frame for receiving and spreading concrete across the surface being paved, and a profile pan behind the hopper extending across the frame for shaping the concrete into slab, the pan having a slip form on each side thereof, comprising the steps of:

removing one of the mobile ground support structures at a rear corner of the frame;

removing the slip form from the side of the profile pan at the side of the frame associated with the removed mobile ground support; and extending the hopper and profile pan outwardly from the side of the frame associated with the removed mobile ground support structure beyond the ground support structure associated with said side.

11. The method of claim 10 wherein the four-track slip form paver includes a hydraulic motor as part of each mobile ground support structure, and further comprising the steps of:

supporting the hydraulic motor associated with the removed mobile ground support structure on the frame; and circulating hydraulic fluid through the motor supported on the frame when the three-track slip form paver is operated.

12. The method of claim 10 wherein the step of extending the hopper and profile pan comprises:

providing an aperture in the end of the hopper on the side of the frame associated with the side where the mobile ground support structure is removed for dispensing concrete outwardly from said side;

supporting a hopper extension on the frame for receiving concrete dispensed outwardly through the aperture; and securing a profile pan extension behind the hopper extension.

* * * * *